US010316506B2

(12) United States Patent
Hawley et al.

(10) Patent No.: US 10,316,506 B2
(45) Date of Patent: Jun. 11, 2019

(54) DETAIN H2O—DETENTION POND RETROFIT DEVICE

(71) Applicants: U.S. Environmental Protection Agency, Washington, DC (US); Sustainable Streams, LLC, Louisville, KY (US)

(72) Inventors: Robert J. Hawley, Louisville, KY (US); James A. Goodrich, Cincinnati, OH (US); Katherine R. MacMannis, Carmel, IN (US)

(73) Assignees: THE UNITED STATES OF AMERICA AS REPRESENTED BY THE ADMINISTRATOR OF U.S. ENVIRONMENTAL PROTECTION AGENCY, Washington, DC (US); SUSTAINABLE STREAMS, LLC, Washington, DC (US)

( * ) Notice: Subject to any disclaimer, the term of this patent is extended or adjusted under 35 U.S.C. 154(b) by 0 days.

(21) Appl. No.: 14/335,567

(22) Filed: Jul. 18, 2014

(65) Prior Publication Data

US 2015/0020886 A1 Jan. 22, 2015

Related U.S. Application Data

(60) Provisional application No. 61/958,027, filed on Jul. 18, 2013.

(51) Int. Cl.
*E03F 5/10* (2006.01)

(52) U.S. Cl.
CPC ..... *E03F 5/106* (2013.01); *Y10T 137/0318* (2015.04); *Y10T 137/794* (2015.04)

(58) Field of Classification Search
CPC combination set(s) only.
See application file for complete search history.

(56) References Cited

U.S. PATENT DOCUMENTS 3,938,713 A 2/1976 Pielkenrood
4,332,507 A 6/1982 Wakamori et al.
(Continued)

OTHER PUBLICATIONS

MacRae, C.R., 1997. Experience from morphological research on Canadian streams: Is the control of the two-year frequency runoff event the best basis for stream channel protection? In: L.A. Roesner (Editor), Effects of Watershed Development and Management of Aquatic Ecosystems: ASCE, New York, pp. 144-162.
(Continued)

*Primary Examiner* — Kyle Armstrong
(74) *Attorney, Agent, or Firm* — Stein IP, LLC

(57) ABSTRACT

Aspects of a detention pond retrofit device for detention basin outlet control provide structures designed to throttle stormwater flow and maintain the rate at which water is discharged from the system below Qcritical, the flow rate at which erosion and down cutting of the receiving stream would begin, based on channel morphology and bed material resistance. The primary goal of the device is to induce increased flow detention during low to moderate rain events, while providing similar hydraulic performance during large events to that of the detention basin performance prior to the installation of the retrofit unit. This is achieved through a "T" or "Y" design with split flow paths, in which the lower path is hydraulically restricted through the installation of structures while the upper path is unrestricted.

18 Claims, 3 Drawing Sheets

(56) References Cited

U.S. PATENT DOCUMENTS 4,363,731 A * 12/1982 Filippi ..... E03F 5/12 210/532.1
4,522,533 A 6/1985 Campbell et al.
5,297,895 A 3/1994 Johnson
5,322,629 A 6/1994 Stewart
5,342,144 A 8/1994 McCarthy
5,549,817 A 8/1996 Horsley et al.
5,707,527 A 1/1998 Knutson et al.
6,638,424 B2 10/2003 Stever et al.
6,783,683 B2 8/2004 Collings
6,926,464 B1 * 8/2005 Weidmann ..... 405/40
7,186,058 B2 3/2007 Schluter et al.
7,473,373 B1 * 1/2009 Danler ..... E03F 1/00 210/162
7,776,217 B2 * 8/2010 Lucas ..... 210/602
7,798,175 B2 * 9/2010 McBride ..... F15D 1/02 138/37
7,980,273 B2 7/2011 Robinson
7,980,784 B2 7/2011 Simpson et al.
8,457,799 B2 * 6/2013 Cox ..... A01G 25/02 239/69
2006/0278289 A1 * 12/2006 Robinson ..... E03F 1/00 138/40
2009/0152181 A1 * 6/2009 Happel ..... E03F 5/12 210/162
2010/0146693 A1 * 6/2010 Yamaguchi ..... E03D 11/08 4/420
2011/0000837 A1 * 1/2011 Roy ..... E03F 5/0405 210/164
2014/0350737 A1 * 11/2014 Goodman ..... G06F 17/5009 700/282

OTHER PUBLICATIONS

Emerson, C.H., Welty, C. and Traver, R., 2003. Application of HEC-HMS to model the additive effects of multiple detention basins over a range of measured storm volumes, World Water and Environmental Resources Congress. ASCE.

Hawley, R.J. 2012. A Regionally-calibrated Approach to 'Channel Protection Controls'—How Meeting New Stormwater Regulations Can Improve Stream Stability and Protect Urban Infrastructure. In Proceedings of the Water Environment Federation Stormwater Symposium, Baltimore, MD, Jul. 18-20.

* cited by examiner

DETAIN H2O—DETENTION POND RETROFIT DEVICE

CROSS-REFERENCE TO RELATED APPLICATIONS

This application claims priority to Provisional Application 61/958,027, filed Jul. 18, 2013, in the U.S. Patent and Trademark Office. All disclosures of the document named above are incorporated herein by reference.

BACKGROUND OF THE INVENTION

1. Field of the Invention

Aspects of the present invention relate to detention basin outlet control structures that are designed to throttle stormwater flow and maintain the rate at which water is discharged from the detention basin below Qcritical, a flow rate at which erosion and down cutting of the receiving stream would begin.

2. Description of the Related Art

Conventional stormwater detention basins are ubiquitous in the developed portions of the U.S., particularly those areas developed since the 1980s. They are abundant stormwater assets that are not being used to their fullest potential, as many traditional flood control detention basins were overly designed for flood control alone and do not include any measures to mitigate erosive flows causing downstream channel instability from hydromodification. This retrofit technology will utilize the excess capacity to optimize detention basins and lessen erosive flows without adversely impacting the flood control capacity of the facility. This technology can be utilized by the Environmental Protection Agency, other state and local government agencies, and the public throughout all developed areas of the U.S.

Urbanization and increased imperviousness alter the hydrology of a watershed, leading to increased runoff volumes, higher and/or longer lasting peak flows, and more frequent runoff events. These hydromodifications can result in accelerated stream bank erosion, stream bed down cutting, and stream instability, and these physical alterations to the stream channel negatively impact water quality (i.e., increased suspended solids), biological communities (through habitat disruption and/or loss) and can endanger infrastructure (i.e., utility lines, roads, bridges, etc.) located adjacent to streams, necessitating costly repairs. Analysis by numerous researchers demonstrates that conventional detention basins designed for peak-flow control have little to no attenuating effect on 97-99% of precipitation volume in a typical year (Emerson et al., 2003; Hawley, 2012) and can cause substantial increases in durations of geomorphically-effective flows that result in corresponding channel instability and enlargement (MacRae, 1997). Because a large portion of the erosive work done on many streams occurs at flows less than the 2-year peak flow (typically the smallest regulated storm in conventional detention basins), retrofit devices that reduce the release rate of these more frequent, erosive flows could be extremely cost-effective at minimizing downstream channel erosion. By installing a relatively inexpensive retrofit technology on an otherwise large, underutilized, and relatively expensive asset, conventional detention basins could be converted into extremely effective assets in improving the nation's urban and suburban waters.

Communities across the nation need to revisit their stormwater regulations and post construction requirements to meet channel protection requirements. A device like this detention pond retrofit technology could have significant implications to government agencies and the public when a government agency begins to mandate management of existing impervious areas, which is already being done, for example, in Maryland. Similar to the presumptive approaches for stormwater management, presumptive approaches for managing impervious areas could very likely be both expensive and ineffective at solving the problem of channel instability. In contrast, calibrating regionally-appropriate solutions and installing green retrofits for detention basin outlet control structures could demonstrate that a regional approach to master planning and retrofitting can be much more cost-effective. Such a device could provide a way for governments and stormwater utilities to spend less money to solve ecologic and water quality problems, but the money would also be spent in ways that protect public infrastructure and results in even more long-term savings to the general public.

SUMMARY OF THE INVENTION

According to an aspect of the present invention, a detention pond retrofit device for detention basin outlet control structures is designed to throttle stormwater flow and maintain the rate at which water is discharged from the system below Qcritical, the flow rate at which erosion and down cutting of the receiving stream would begin based on channel morphology and bed material resistance.

According to another aspect of the present invention, the general field of application of green retrofits for detention basin outlet control structures is to cost-effectively provide stream channel protection as well as water quality benefits, ultimately improving the aquatic habitat and ecologic function of the streams as well as protecting public infrastructure.

Generally, detention basin retrofits are not a completely new technology, as several stormwater utilities across the U.S. have promoted retrofit concepts to transform existing detention basins into water quality basins or extended detention basins. However, retrofit approaches used to date tend to be either expensive grading operations or overly simple flow restriction devices that do not adequately allow for bypass of the higher flows that are important for maintaining flood control performance. The more expensive, construction/grading approaches are often intended to maximize the flow path and slow stormwater through the basin, to increase vegetation in order to promote absorption, evapotranspiration, and filtration of pollutants, and improve soil saturation/groundwater recharge. These concepts are achieved by removing concrete low-flow channels, modifying outlet structures for the basins to hold water during smaller storm events, installing a sediment forebay element to the basin, and planting vegetation. Many outlet control retrofits have involved the simple installation of a weir plate to hold a shallow volume of water in the basin to retain water from small storms. While these retrofit ideas have been promoted by stormwater utilities across the country to improve water quality, a simple outlet control retrofit device that addresses water quality as well as downstream channel protection has not been developed to date. According to another aspect of the present invention, the detention pond retrofit device is designed to be low-cost to manufacture, install, and maintain while being capable of maintaining the rate at which water is discharged from the detention pond and enhancing water quality benefits.

In addition, many extended detention basins include retrofits to the outlet control structure to prevent clogging by utilizing a reverse flow pipe, which is constructed with either a pipe on a negative slope or with a turned pipe elbow. None of the approaches provide a bypass feature to maintain the flood control performance of the basin during the extreme events, while enhancing the channel protection and water quality performance during more frequent events. Furthermore, none of the previous approaches have calibrated the retrofit device to optimize the basin performance relative to the erosive resistance of the receiving channel.

One goal of the detention pond retrofit device, according to another aspect of the present invention, is to induce increased flow detention during low to moderate rain events (e.g., up to the 2-year event), while providing similar hydraulic performance during large events (e.g., 100-year event) to that of the detention basin performance prior to the installation of the retrofit unit. This is achieved through a "T" or "Y" design with split flow paths, in which the lower path is hydraulically restricted (through the installation of a restrictor plate, media, or combination thereof), while the upper path is unrestricted. The dimensions of the retrofit unit, including the restrictor plate length (e), the diameter of the staged outlet structure (c, also referred to as the "bypass"), the height of the bypass relative to the existing outlet elevation (a), the angle of the bypass (a), presence or absence of wire mesh/debris gates, presence or absence of filter media and length (b), hydraulic restriction properties (x) and filtration properties (y) can be optimized through hydraulic and/or water quality modeling of the individual detention basin being retrofit.

According to another aspect of the present invention, the physical mounting of the retrofit unit and diameter of the unit (d) can be determined by the configuration of the existing outlet control structure. Mounting may require stabilizing bars, bolts, or straps. Custom interfaces may be needed for mounting to outlet structures composed of cylindrical surfaces and/or those structures with "slot" outfalls as opposed to round "pipe" outfalls.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
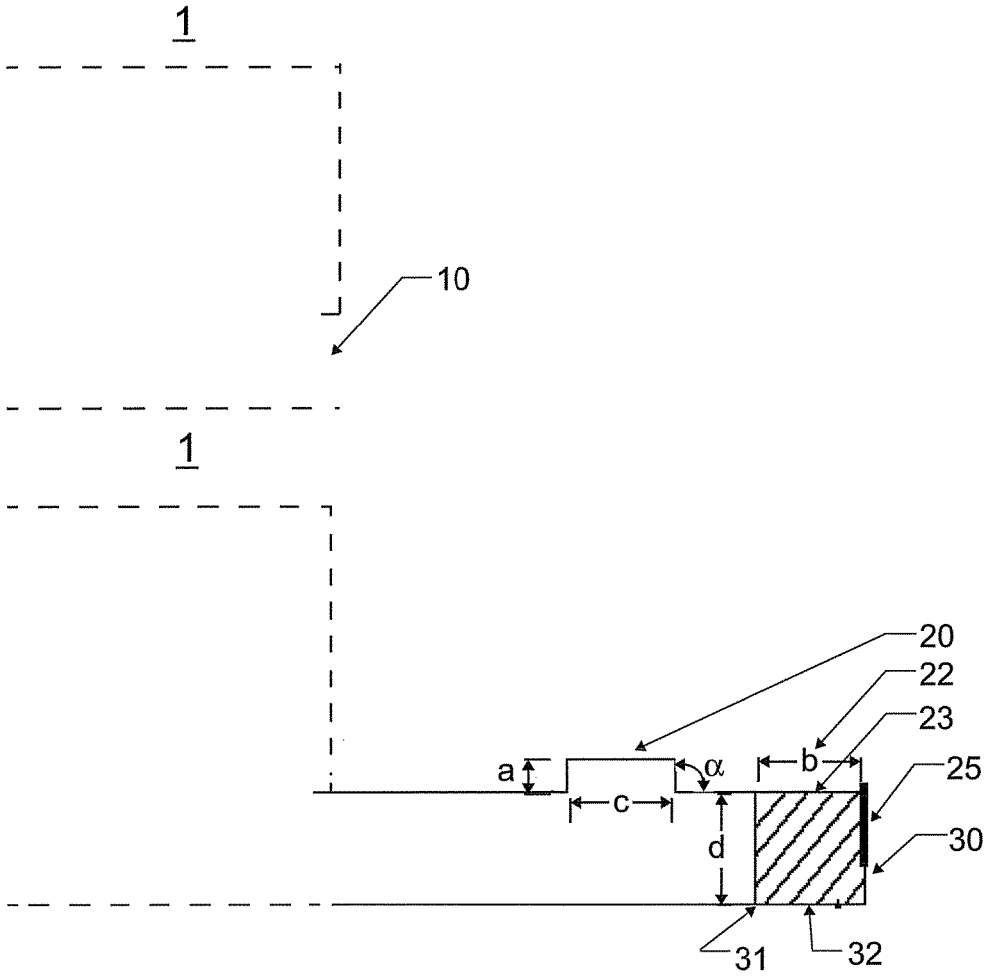
FIG. 1 is an illustration of a profile view of a detention basin with an unrestricted flow path and with a retrofit restriction device according to an aspect of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
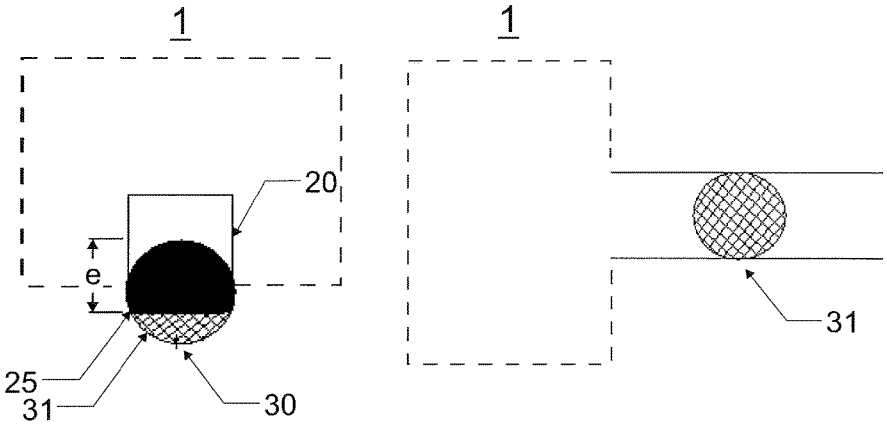
FIG. 2 is cross-section view and a plan view of the detention basin and the retrofit restriction device according to an aspect of the present invention.

FIG. 1 is an illustration of a profile view of a detention basin 1 with an unrestricted flow path 10 prior to installation of the retrofit restriction device 22 according to an aspect of the present invention and a detention basin 1 with the retrofit restriction device 22. FIG. 2 is a cross section view and plan view of the retrofit restriction device 22 according to an aspect of the present invention. The primary goal of the retrofit restriction device 22 is to induce increased flow detention during low to moderate rain events (e.g. up to the 2-year event), while providing similar hydraulic performance during large events (e.g. 100-year event) to that of the detention basin 1 performance prior to the installation of the retrofit restriction device 22. This is achieved through a "T" design (FIGS. 1 and 2) or "Y" design (FIG. 3) with split flow paths, comprising a staged retrofit restriction device 22 in which the lower path 30 is hydraulically restricted (through the installation of a restrictor plate 25, wire or mesh plate 31 or media 32, or combination thereof), while flow is unrestricted through the unrestricted upper flow path 20. The dimensions of the retrofit restriction device 22, including the restrictor plate 25 length (e), the diameter of the staged outlet structure (c, also referred to as the "bypass"), the height of the bypass 2022 relative to the existing outlet elevation, (a), the angle between the unrestricted upper flow path 20 and the retrofit restriction device 22, ($\alpha$), presence or absence of wire mesh or debris gates (31), presence or absence of filter media (32) and length (b), hydraulic restriction properties (x) and filtration properties (y) of the retrofit restriction device 22 can be optimized through hydraulic and/or water quality modeling of the individual detention basin 1 being retrofit.

The physical mounting of the retrofit restriction device 22 and diameter of the unit (d) can be determined by the configuration of the unrestricted flow path 10. Mounting may require stabilizing bars, bolts, or straps (not shown). Custom interfaces may be needed for mounting to outlet structures of the unrestricted flow path 10 such as cylindrical surfaces and/or those structures with "slot" outfalls as opposed to round "pipe" outfalls.

Figure 3:
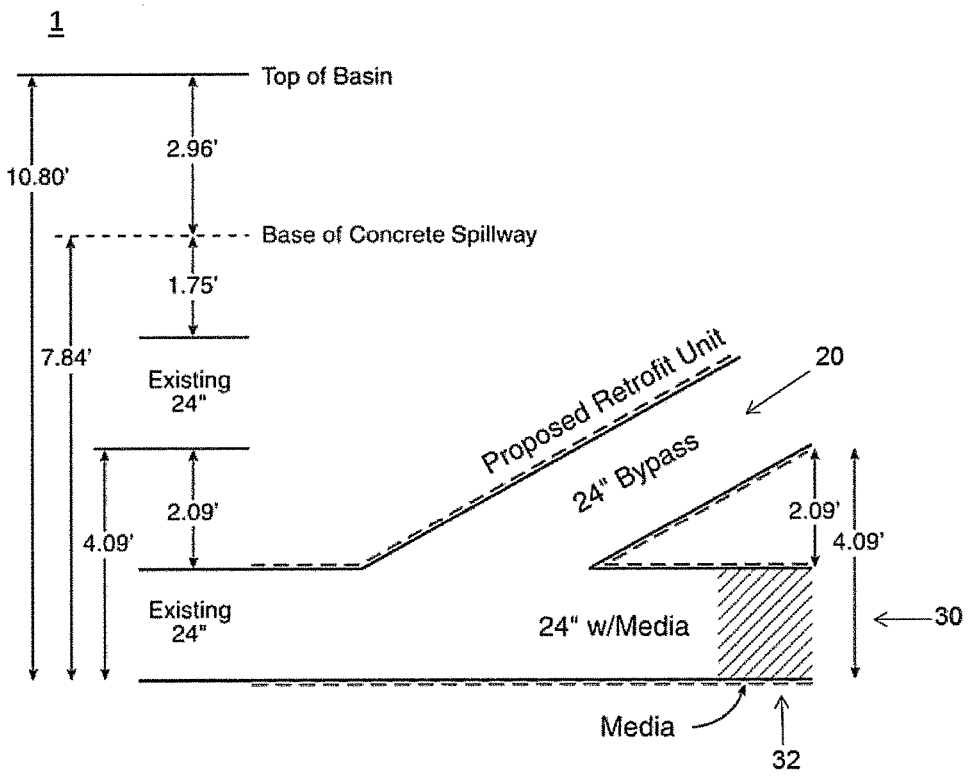
FIG. 3 is an engineering drawing of an embodiment of the retrofit restriction device according to another aspect of the present invention.

FIG. 3 is an engineering drawing of an embodiment of the detention basin 1 and retrofit restriction device 22 according to another aspect of the present invention. As an example of the present invention, it is a specific embodiment of the retrofit unit for a pilot installation that exhibits an angle ($\alpha$) of 45°, height of bypass (a) of 2.09 feet, bypass diameter (c) of 24 inches, and hydraulic restriction properties (x) of the media 32 and/or restrictor plate 25 of 75%.

The specific combinations of design parameters are somewhat infinite, and will depend on the specific hydraulic performance needs of the detention basin 1 being retrofit. However, one embodiment could be a product line to include prefabricated retrofit restriction devices 22 of the more commonly needed size ranges to make such a product easier to market. Instruction manuals could also be developed related to optimization and sizing procedures and modeling steps. Prefabricated units with adjustable components (e.g., restrictor plate 25 height) could be field adjusted by installing a gate valve design as opposed to a fixed plate. Retrofit restriction devices 22 with remote sensing capacity and valves with real-time control could also be developed. Interchangeable media filters and specifically designed media for both hydraulic restriction and water quality filtration are also likely extensions of this technology. This real-time monitoring and control could be applied to larger regional basins and operate a watershed much like a system or treatment train in order to optimize flood control and water quality on a network scale.

The hydraulic optimization procedure will resemble the conventional design procedure in which engineers optimize the outlet control structure to achieve various flow targets; but will be expanded to include the goal of releasing as many storms as possible below the flow rate that is deemed appropriate for the erosive resistance of the receiving channel. In some jurisdictions, such as New York State, guidance may suggest or require a fluvial geomorphic assessment of the receiving channel in order to estimate that critical flow. In other jurisdictions, such as Sanitation District No. 1 of Northern Kentucky, a regional target may be established such as 40% of the pre-developed 2-year peak flow. In still other jurisdictions, professional expertise may be required to estimate the critical flow of the receiving stream in the absence of other guidance.

Other optimization criteria may include desired detention times of specific storms, for example, for water quality treatment. In all cases, the optimization procedure can include relevant local design criteria, including but not limited to 1) draw down requirements for mosquito control, 2) meeting the peak flow control performance of the standard design events (e.g. 2-, 5-, 10-, 25-, 50-, and 100-year). Even in the absence of local design criteria, installations should be optimized to maintain similar hydraulic performance for the 100-year event to that of the detention basin performance prior to retrofit installation.

The physical mounting of the retrofit unit and diameter of the unit (d) will be determined by the configuration of the existing outlet control structure. Mounting may require stabilizing bars, bolts, or straps. Custom interfaces may be needed for mounting to outlet structures composed of cylindrical surfaces and/or those structures with "slot" outfalls as opposed to round "pipe" outfalls.

Aspects of the present invention are therefore novel because they address channel protection without impacting the flood control performance of the outlet structure, as well as water quality implications. Optimizing detention facilities to economically release runoff below a critical point, Qcritical, for small and intermediate storm events should enable stormwater managers nationwide to cost-effectively achieve multiple objectives including hydromodification, water quality, and flooding issues throughout the watershed. Additionally, the above mentioned detention pond retrofit device should improve in-stream habitat and ecosystem functionality. Each retrofit restriction device will ideally be sized and properly designed with channel protection, water quality, and flood control in mind.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A stormwater detention basin containing an existing outlet control structure, wherein a retrofit unit is mounted to said existing outlet control structure inside of the basin, said retrofit unit comprising: an unrestricted upper flow path containing a bypass; and a lower flow path containing a retrofit restriction device, wherein the retrofit unit is mounted to the existing outlet control structure at the lowest volume water flow path of the existing outlet control structure, the retrofit restriction device is configured to increase water detention in the basin in response to low to moderate rain events and reduce the rate at which water is discharged from the stormwater detention basin below Qcritical; the unrestricted upper flow path and the lower flow path of the retrofit unit are connected to form two parallel flow paths for water flow out of the stormwater detention basin, and the bypass allows a portion of the water to bypass the lower flow path in response to an extreme rain event.

2. The detention basin of claim 1, wherein the retrofit restriction device is hydraulically restricted.

3. The detention basin of claim 2, wherein the hydraulically restricted lower flow path of the retrofit unit includes at least one of a restrictor plate, filter media, filter fabric, wire mesh, debris gates, and a structural support.

4. The detention basin of claim 1, wherein the retrofit restriction device is prefabricated with adjustable components.

5. The detention basin of claim 1, wherein the retrofit restriction device is fitted with remote sensing capacity and valves with real-time control.

6. The detention basin of claim 5, wherein the remote sensing capacity and valves with real-time control are applied to regional basins and control a watershed.

7. The detention basin of claim 3, wherein the filter media are interchangeable.

8. The detention basin of claim 3, wherein the filter media are designed for hydraulic restriction and water quality filtration.

9. The detention basin of claim 2 having a design angle between the unrestricted upper flow path and the lower flow path containing the retrofit restriction device, wherein the design angle between the unrestricted upper flow path and the lower flow path containing the retrofit restriction device is a "T" design or a "Y" design.

10. The detention basin of claim 9, wherein:

the design angle between the unrestricted upper flow path and the lower flow path containing the retrofit restriction device is 45°, the diameter of an outlet from the detention basin, unrestricted upper flow path, and hydraulically restricted lower path are the same, and the hydraulic restriction is filter media.

11. A method of regulating stormwater flow from a stormwater detention basin containing an outlet control structure, said method comprising: splitting water flow entering the lowest volume water flow path of the existing outlet control structure into an unrestricted upper flow path containing a bypass and a restricted lower flow path containing a retrofit restriction device, wherein the retrofit restriction device is configured to increase water detention in the basin in response to low to moderate rain events and reduce the rate at which water is discharged from the stormwater detention basin below Qcritical, the unrestricted upper flow path and the lower flow path of the retrofit unit are connected to form two parallel flow paths for water flow out of the stormwater detention basin, and the bypass allows a portion of the water to bypass the lower flow path in response to an extreme rain event.

12. The method of claim 11, wherein the retrofit restriction device is hydraulically restricted.

13. The method of claim 12, wherein the hydraulically restricted lower flow path includes one or more of a restrictor plate, filter media, filter fabric, wire mesh, debris gates, or a structural support.

14. The method of claim 11, wherein design parameters of the restricted and unrestricted flow paths are optimized through hydraulic or water quality modeling of the detention basin.

15. The method of claim 14, wherein the design parameters of the restricted and unrestricted flow paths include at least one of angles between the hydraulically restricted and unrestricted flow paths, dimensions of a restrictor plate, diameter of the retrofit restriction device, the height of the retrofit restriction device to the unrestricted upper flow path, the presence or absence of wire mesh/debris gates, the presence or absence of filter media, and hydraulic restriction and filtration properties of the retrofit restriction device.

16. The method of claim 12, wherein:

the restricted lower flow path and unrestricted upper flow path form a "Y" shape, the diameter of an outlet from the detention basin, the restricted flow path, and the unrestricted flow path are the same, and the restriction is filter media.

17. A retrofit unit mounted to an existing outlet control structure located in a stormwater detention basin, said retrofit unit comprising: an unrestricted upper flow path containing a bypass; and a lower flow path containing a retrofit restriction device, wherein the retrofit unit is mounted to the existing outlet control structure inside the basin at the lowest volume water flow path of the existing outlet control structure, the retrofit restriction device is configured to increase water detention in the basin during low to moderate rain events and reduce the rate at which water is discharged from the stormwater detention basin below Qcritical, the bypass allows a portion of the water to bypass the lower flow path in response to an extreme rain event, and the unrestricted upper flow path and the lower flow path of the retrofit unit are connected to form two parallel flow paths for water flow out of the stormwater detention basin.

18. The method of claim 11, comprising adjusting design parameters to induce increased water detention through the hydraulically restricted path during low to moderate rain events and providing similar hydraulic performance through the hydraulically restricted path to that of the detention basin prior to the installation of the retrofit restriction device.

* * * * *